United States Patent [19]

Sagawa et al.

[11] Patent Number: 5,011,377

[45] Date of Patent: Apr. 30, 1991

[54] SWASH-PLATE TYPE PISTON PUMP MOTOR

[75] Inventors: Toyoaki Sagawa; Makoto Sonoda; Tokihiko Umeda, all of Kobe, Japan

[73] Assignee: Kawasaki Jukogyo Kabushiki Kaisha, Hyogo, Japan

[21] Appl. No.: 566,531

[22] Filed: Aug. 10, 1990

[30] Foreign Application Priority Data

Sep. 12, 1988 [JP] Japan ..... 63-227682

[51] Int. Cl.[5] ..... F04B 1/10; F04B 1/12; F04B 1/20

[52] U.S. Cl. ..... 417/269; 74/60; 91/499; 92/71; 92/57

[58] Field of Search ..... 91/499, 503; 417/269, 417/271; 92/57, 71; 74/60

[56] References Cited

U.S. PATENT DOCUMENTS

| | | | |
|---|---|---|---|
| 3,277,835 | 10/1966 | Wahlmark | 74/60 |
| 3,978,772 | 9/1976 | Miyao | 91/499 |
| 4,602,554 | 7/1986 | Wagenseil | 91/499 |
| 4,611,529 | 9/1986 | Stricker | 417/269 |
| 4,620,475 | 11/1986 | Watts | 91/499 |

FOREIGN PATENT DOCUMENTS 62-174579 7/1987 Japan .

*Primary Examiner*—Leonard E. Smith
*Assistant Examiner*—Alfred Basichas
*Attorney, Agent, or Firm*—Wenderoth, Lind & Ponack

[57] ABSTRACT

A swash-plate type piston pump motor has a housing assembly comprising: an end plate for rotatably supporting a cylinder rotor against thrust loads in its axial direction and also rotatably supporting the upper end of an output shaft; a cylinder side peripheral wall encompassing the cylinder rotor; an inner peripheral wall which is joined contiguously to the cylinder side peripheral wall and extends downward toward the lower end of the output shaft. The inner peripheral wall encloses and supports a swash plate in an inclined state. A downwardly extending outer peripheral wall is also joined contiguously to the cylinder side peripheral wall and is flared outward toward the lower end of the output shaft, an annular space being formed between the inner and outer peripheral walls. The maximum flare angle of the outer peripheral wall relative to the axial direction of the output shaft is 30 degrees. The outer peripheral wall has at its open flare extremity a motor mounting flange. The rigidity of the outer peripheral wall is thereby increased, and generation of vibrations and noise therefrom is effectively prevented. The outer peripheral wall also functions as a shield to contain and suppress noise generated at the outer surface of the inner peripheral wall.

5 Claims, 2 Drawing Sheets

SWASH-PLATE TYPE PISTON PUMP MOTOR

BACKGROUND OF THE INVENTION

The present invention relates generally to swash-plate type piston pump motors. More particularly, the invention relates to piston pump motors of the type wherein translational movements in the axial direction of pistons actuated by hydraulic pressure are converted into rotational movement by utilizing a swash plate.

In a piston pump motor of this type, a cylinder block or rotor is coaxially mounted on and coupled by a spline to an output shaft or rotating shaft. Within this cylinder rotor are formed cylinder bores in which respective pistons of reciprocating type are slidably fitted. A swash-plate part is fixedly mounted with an inclined attitude relative to the output shaft. One end of each piston is in abutting contact, by way of a shoe functioning as a universal joint, with the swash-plate part. The other end of the piston faces a hydraulic pressure chamber of the corresponding cylinder bore.

Hydraulic pressure is supplied from the outside into each hydraulic pressure chamber to actuate the piston axially toward the swash-plate part. This translational motion in the axial direction is converted into rotation of the cylinder rotor and therefore of the output shaft. Furthermore, during operation each shoe slides in rubbing contact with the swash-plate part as it presses thereagainst. In order to obtain smooth sliding action between these moving parts, hydraulic oil is supplied from the hydraulic pressure chamber, through a throttle hydraulic fluid passage, to the pressing sliding surfaces of these moving parts.

In a conventional piston pump motor of this construction, a pressure arising from pressure fluctuations in the hydraulic pressure chambers is transmitted from the cylinder rotor to one of the end walls of a housing assembly enclosing all working parts. In a state of offset phase relative to this pressure, a pressure corresponding to fluctuations in the pressure of the pressing sliding surfaces is transmitted from the swash-plate part to the other end wall of the housing assembly. In addition, as a consequence of factors such as an inertial effect, loads arising from the reciprocating motions of the pistons are transmitted with mutually different timing to both end walls of the housing assembly. These pressures and loads having timing lags are propagated or transmitted from both end walls to the entire housing. Consequently, the housing assembly undergoes out-of-plane vibration and thereby generates noise.

More specifically, a piston pump motor is ordinarily provided with a flange for coupling to a relatively large speed-changing mechanism. This flange extends outwardly in radial directions from one end part of the peripheral wall or barrel part of the housing assembly. The annular mounting seat of the outer peripheral edge part of this flange is adapted to be fixed to the case of the speed-changing mechanism. Consequently, this flange is of a construction which readily undergoes out-of-plane vibration. When pressures and loads causing vibrations are transmitted to the housing assembly as described above, the mounting flange undergoes an out-of-plane vibration of large magnitude, and noise is generated.

With the aim of producing a construction for preventing noise of this character, the additional provision of a vibration-suppressing steel plate at the swash-plate part has been proposed in Japanese Utility Model Application Laid-Open Publication No. 62-98779. This vibration-suppressing steel plate comprises two steel plates and a special viscoelastic resin sandwiched therebetween. By the use of the device disclosed in this publication, the transmission of vibration from the swash-plate side to the housing can be suppressed by the vibration-suppressing steel plate.

Another noise-preventing construction featuring improvements in the housing construction is disclosed in Japanese Patent Application Laid-Open Publication No. 62-174579. In this device, the thickness of the end wall on the side opposite the swash plate part of the housing is made extremely large thereby to increase the rigidity. The thick end wall and the swash plate supporting part are connected by long bolts.

In the construction disclosed in the above cited first reference, Japanese Utility Model Application Laid-Open Publication No. 62-98779, the vibration-suppressing steel plate is a part of special fabrication, which unavoidably increases the production cost.

On the other hand, in the construction proposed in the above cited second reference, Japanese Patent Application Laid-Open Publication No. 62-174579, and extremely thick end plate is used, whereby the dimension in the axial direction and the weight of the entire device increase.

Furthermore, in each of the constructions of the above cited references, the generation of vibration to some degree in the housing is unavoidable. This vibration becomes noise, which cannot be prevented from being transmitted to the outside.

SUMMARY OF THE INVENTION

In consideration of the above described state of the prior art, it is a general object of the present invention to provide a swash-plate type piston pump motor in which a measure for preventing vibrations and a measure for shielding noise are both effectively carried out.

The above object and other objects have been achieved by this invention, according to which there is provided a swash-plate type piston pump motor comprising: an output shaft having first and second ends; a cylinder rotor concentrically encompassing and coupled to said output shaft thereby to rotate unitarily therewith and having a plural number of cylinder bores formed therein around the output shaft with axial orientations parallel to the axis of the output shaft; a number of pistons slidably fitted in respective cylinder bores, each piston at one end thereof and a head end of the respective cylinder bore forming therebetween a hydraulic pressure chamber; a number of shoes coupled to the other ends of respective pistons in a manner to function as universal joints; a swash plate of annular shape encompassing the output shaft and fixedly supported with an inclined orientation relative to the output shaft, said shoes being in pressing sliding contact with an inclined swash surface of said swash plate; and a housing assembly enclosing the above named parts and comprising: a cylinder side peripheral wall means encompassing the cylindrical periphery of said cylinder rotor; an inner peripheral wall joined contiguously to said cylinder side peripheral wall and extending away therefrom toward said second end of the output shaft, said inner peripheral wall enclosing and fixedly supporting said swash plate and rotatably supporting the output shaft at a part thereof near said second end; an outer peripheral wall joined contiguously to said cylinder side peripheral wall on the outer side of and apart from said inner peripheral wall and flaring radially outwardly from the output shaft and in the direction of said second end, an annular space being formed between said inner and outer peripheral walls, said outer peripheral wall having at an extremity a motor mounting flange; and an end plate fixed to the end of said cylinder side peripheral wall remote from said motor mounting flange and rotatably supporting said first end of the output shaft, said end plate further supporting said cylinder rotor against thrust loads in the direction of said first end.

According to the above described structural organization of this invention, the peripheral wall part joined to the motor mounting flange is of cylindrical shape or is formed as an outer peripheral part flared toward the motor mounting flange. This differs from the known construction wherein a wall part (wall part for providing a mounting seat) connected to a motor mounting seat is formed by an outwardly direct flange. Because of this difference, the construction of this invention increases the rigidity of the wall part for mounting, and generation of vibrations and noise can be effectively prevented.

Furthermore, the inner peripheral wall is encompassed by the outer peripheral wall spaced apart therefrom by an annular space. As a result, noise generated at the outer surface of the inner peripheral wall is shielded and contained by the outer peripheral wall and is effectively prevented from being transmitted to the outside.

The nature, utility, and further features of the present invention will be more clearly apparent from the following detailed description with respect to preferred embodiments of the invention when read in conjunction with the accompanying drawings.

DETAILED DESCRIPTION OF THE PREFERRED EMBODIMENTS

Figure 1:
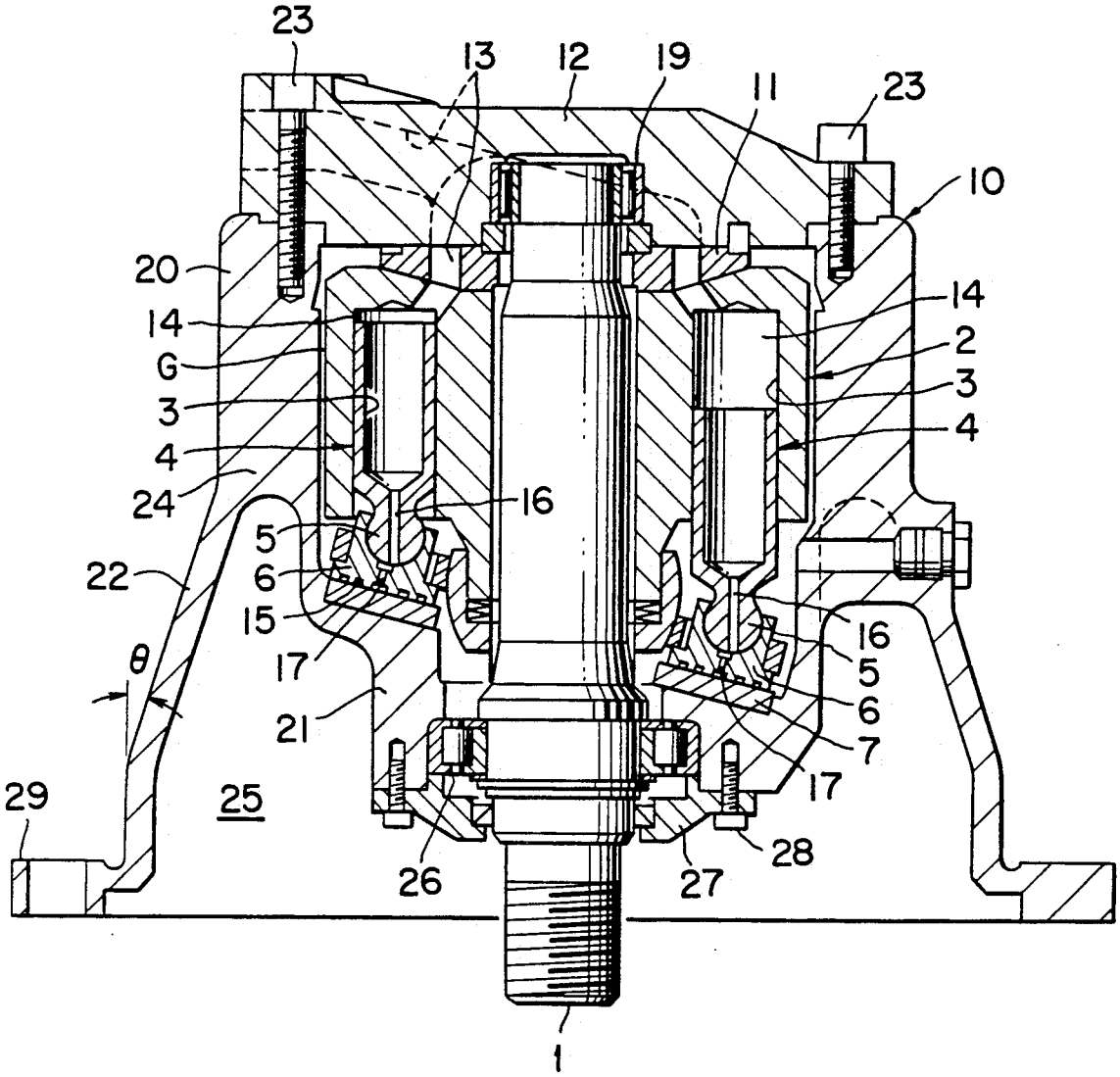
FIG. 1 is a side view in longitudinal section of an embodiment of the piston pump motor according to this invention.

Referring first to FIG. 1, a piston pump motor constituting an embodiment of the present invention shown therein has a centrally positioned vertical output shaft 1. This output shaft 1 is coupled by a spline to an annular cylinder block or rotor 2 disposed concentrically around the output shaft 1. The cylinder rotor 2 is provided with a plurality of cylinder bores 3 formed therein to extend in the axial direction (direction parallel to the output shaft 1) with respective axes at spaced-apart positions around the output shaft 1. Each cylinder bore 3 has an upper (as viewed in the figure) head end and a lower open skirt end.

A piston 4 is slidably fitted in each cylinder bore 3. Each piston 4 has a lower ball end 5 of spherical shape extending downward and out of its cylinder bore 3 through the lower skirt end thereof. Each ball end 5 is slidably fitted in a spherical socket formed in a shoe 6. Thus each ball end 5 and its shoe 6 constitute a form of ball-and-socket joint. The lower face of each shoe 6 is pressed against and in slidable contact with the upper face of a swash plate 7. This swash plate 7 is an annular flat plate mounted on an inclined bottom surface of the hollow interior of a housing assembly 10. Thus the swash plate 7 is supported to encompass the output shaft 1 with an inclined orientation relative thereto without contacting it.

The upper end surface of the cylinder rotor 2 is in slidable contact as a valve seat member with the lower surface of an annular valve plate 11. This valve plate 11 is disposed concentrically around but free of the output shaft 1 and is fixed in intimate contact with the inner or lower surface of an upper end plate 12 of the housing assembly 10. The upper end plate 12 is provided at the center of its lower surface with a cylindrical hole for accommodating the upper end of the output shaft 1. A bearing 19 is fitted in this hole for rotatably supporting the upper end of the output shaft 1.

The upper end plate 12 and the valve plate 11 are provided with inlet and outlet passages for hydraulic fluid which communicate with an outside hydraulic system (not shown). Only one kind of hydraulic fluid passage 13 is shown in FIG. 1. The upper part of the cylinder rotor 2 is provided therethrough with a hydraulic fluid passage for communicating the above described inlet and outlet passages with a hydraulic pressure chamber 14 above the piston 4 in each cylinder bore 3 as determined by the valve plate 11.

In the operation of the instant embodiment of the piston pump motor, hydraulic pressure is introduced from the outside hydraulic pressure system, through the hydraulic fluid passage 13, and into an oil pressure chamber 14. The piston 4 beneath this pressure chamber 14 therefore pushes downward on its shoe 6 relative to the swash plate 7. The resulting reaction force acts on the piston 4 to cause it to revolve in a rotational direction about the output shaft 1. In concert with this action, the cylinder rotor 2 and the output shaft 1 also rotate. As the cylinder rotor 2 thus rotates, the hydraulic fluid passage connected to each hydraulic pressure chamber 14 is changed over periodically by the valve action of the valve plate 11 between the inlet fluid passage and the outlet fluid passage. Accordingly, the force of the oil acting from each hydraulic pressure chamber 14 on its piston 4 is also changed over for every half revolution of the output shaft 1 between a positive direction (pushing direction) and a negative direction (retracting direction). Thus the cylinder rotor 2 and the output shaft 1 are rotated continuously.

In the above described operation, it is necessary that the sliding action at the mutually pressed sliding surfaces 15 of each shoe 6 and the swash plate 7 be carried out smoothly. For ensuring this operational state, each piston 4 is provided therethrough with a hydraulic fluid passage 16 extending from the hydraulic pressure chamber 14 to the extreme end of the ball end 5. In addition, through each shoe 6, a throttled hydraulic fluid passage 17 is formed to connect the passage 16 and the sliding surfaces 15.

The above described structural organization of a swash-plate type piston pump motor is known. According to the present invention, the following innovations and resulting improvements have been made in the housing assembly 10 enclosing the above described operational parts.

The housing assembly 10 comprises, in addition to the aforedescribed upper end plate 12, a cylinder side peripheral wall 20, an inner peripheral wall 21, and an outer peripheral wall 22, these three walls 20, 21, and 22 being formed as an integral structure.

The cylinder side peripheral wall 20 is a relatively thick structural part of substantially cylindrical shape. The upper end plate 12 is fixed around its peripheral part by a plurality of bolts 23 to the upper end part of this cylinder side peripheral wall 20. This peripheral wall 20 encompasses the cylinder rotor 2 with a clearance gap G provided therebetween. Its lower end part 24 is positioned at a vertical level near the lower end part of the cylinder rotor 2 and above the pressure sliding surfaces 15.

The inner peripheral wall 21 is contiguously joined to the inner lower part of the lower end part 24 of the peripheral wall 20. The inner peripheral wall 21 extends from the lower end part 24, around and underneath the swash plate 7, to a lower end into which a lower bearing 26 of the output shaft 1 is fitted. The lower surface and outer peripheral surface of the swash plate 7 are fixed in a state of intimate adhesion to the inner surface of the inner peripheral wall 21. An annular cover 27 encompassing the lower part of the output shaft 1 is fixed by bolts 28 to the lowermost surface of the inner peripheral wall 21.

The outer peripheral wall 22 at its upper end is formed contiguously with the lower end part 24 of the cylinder side peripheral wall 20 and extends downward with a skirt-like outward flare. An annular space 25 is formed between the outer peripheral wall 22 and the inner peripheral wall 21. With the exception of its lower end part, the outer peripheral wall 22 is generally tapered upward with a taper angle $\theta$ (angle of inclination of the wall relative to the direction of the output shaft 1). The value of this taper angle $\theta$ is in the range of 0° to 30°. A motor mounting flange 29 of annular shape is formed integrally around the lower rim part of the outer peripheral wall 22. A speed-reduction device (not shown) is bolted onto this motor mounting flange 29.

According to the above described construction, the peripheral wall contiguously formed with the motor mounting flange 29 is constituted by the outer peripheral wall 22 which flares outward and downward toward the mounting flange 29. For this reason, the rigidity of this outer peripheral wall 22 (functioning as a mounting flange structure) is high, whereby it effectively suppresses vibration and noise generated thereby.

Furthermore, this outer peripheral wall 22 encompasses the inner peripheral wall 21 with an annular space 25 formed therebetween. For this reason, noise generated on the outer surface of the inner peripheral wall 21 is shielded by the outer peripheral wall 22 and is thereby effectively prevented from being transmitted to the outside.

The piston pump motor according to this invention as described above has the following features of merit and utility. The vibrations of the housing assembly 10 itself can be effectively prevented. Moreover, vibrations arising in the vicinity of the swash plate 7 are effectively prevented from being transmitted to the outside. Still another feature is that there is no necessity of using special vibration suppressing steel plates or extremely thick end walls, whereby the production cost can be reduced. At the same time the construction can be miniaturized and simplified.

Figure 2:
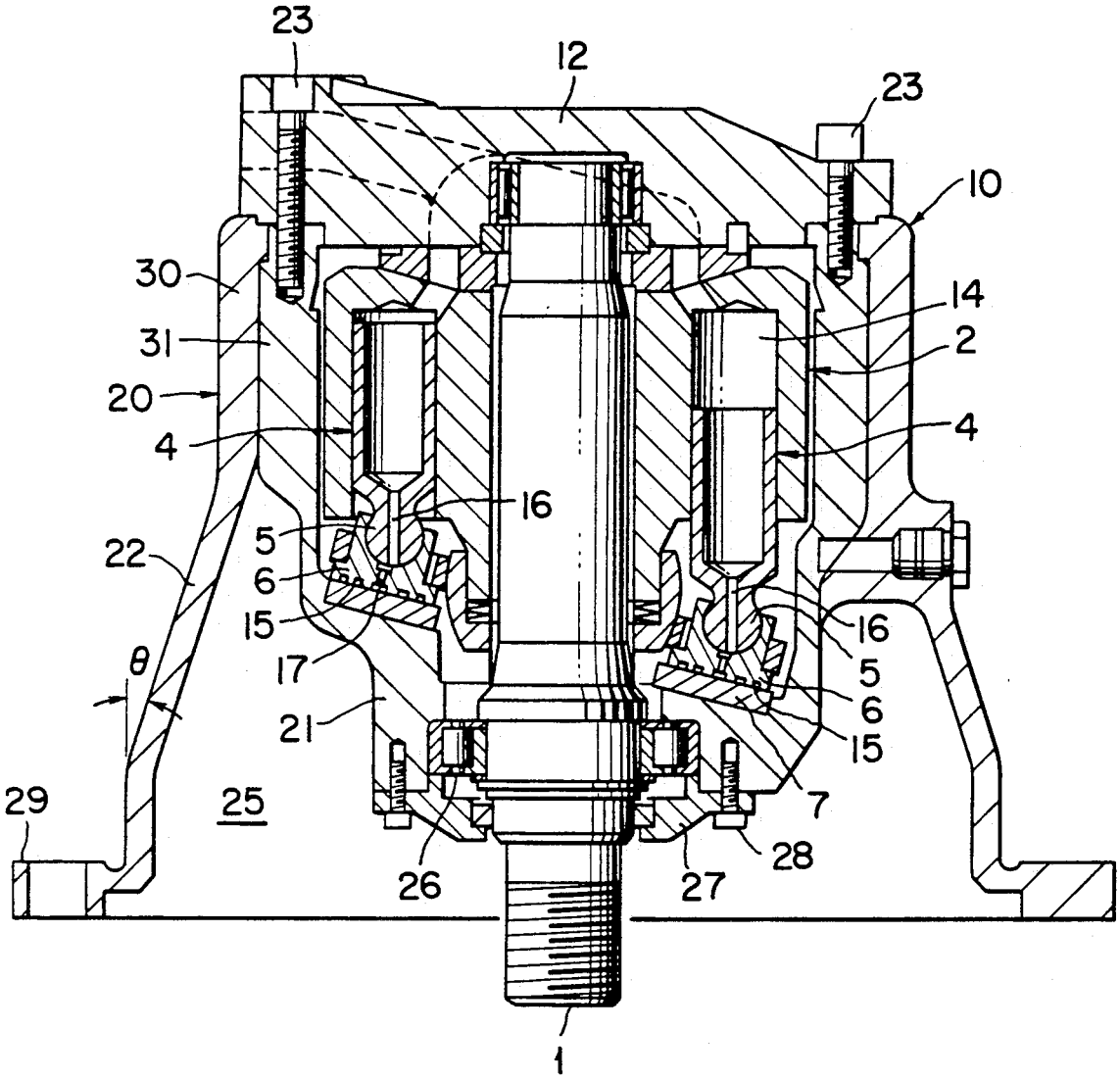
FIG. 2 is a similar side view of another embodiment of the piston pump motor.

In the embodiment of the piston pump motor described above and illustrated in FIG. 1, the cylinder side peripheral wall 20, the inner peripheral wall 21, and the outer peripheral wall 22 are formed as an integral structure. In another embodiment of the invention as shown in FIG. 2, the cylinder side peripheral wall 20 is constituted by two separate parts, namely, an outer peripheral part 30 and an inner peripheral part 31. Both of these peripheral parts 30 and 31 are fixed to each other. At the same time, the outer peripheral wall 22 is formed unitarily with the outer peripheral part 30, while the inner peripheral wall 21 is formed unitarily with the inner peripheral part 31. In other respects, this construction is the same as that of the preceding embodiment illustrated in FIG. 1.

What is claimed is:

1. A swash-plate type piston pump motor comprising: an output shaft having first and second ends;

a cylinder rotor concentrically encompassing and coupled to said output shaft thereby to rotate unitarily therewith and having a plural number of cylinder bores formed therein around the output shaft with axial orientations parallel to the axis of the output shaft;

a number of pistons slidably fitted in respective cylinder bores, each piston at one end thereof and a head end of the respective cylinder bore forming therebetween a hydraulic pressure chamber;

a number of shoes coupled to the other ends of respective pistons in a manner to function as universal joints;

a swash plate of annular shape encompassing the output shaft and fixedly supported with an inclined orientation relative to the output shaft, said shoes being in pressing sliding contact with an inclined swash surface of said swash plate; and a housing assembly enclosing the above named parts and comprising: a cylinder side peripheral wall means encompassing the cylindrical periphery of said cylinder rotor; an inner peripheral wall joined contiguously to said cylinder side peripheral wall and extending away therefrom toward said second end of the output shaft, said inner peripheral wall enclosing and fixedly supporting said swash plate and rotatably supporting the output shaft at a part thereof near said second end; an outer peripheral wall joined contiguously to said cylinder side peripheral wall on the outer side of and apart from said inner peripheral wall and flaring radially outwardly from the output shaft and in the direction of said second end, an annular space being formed between said inner and outer peripheral walls, said outer peripheral wall having at an extremity a motor mounting flange; and an end plate fixed to the end of said cylinder side peripheral wall remote from said motor mounting flange and rotatably supporting said first end of the output shaft, said end plate further supporting rotatably said cylinder rotor against thrust loads in the direction of said first end.

2. The swash-plate type piston pump motor as claimed in claim 1, wherein hydraulic fluid passages are formed through said end plate and said cylinder rotor to supply hydraulic pressure from an external hydraulic pressure source to each of said hydraulic pressure chambers, and additional hydraulic fluid passages are formed through each of said other ends of the pistons and through each of said shoes to supply hydraulic fluid as a lubricant to the surfaces of the shoes and said swash plate in said pressing sliding contact.

3. The swash-plate type piston pump motor as claimed in claim 1, wherein said end plate and said cylinder side peripheral wall means are respectively constituted by mutually separate structural members.

4. The swash-plate type piston pump motor as claimed in claim 1, wherein said cylinder side peripheral wall comprises an outer peripheral part and an inner peripheral part fixed to and enclosed substantially concentrically in said outer peripheral part, said outer peripheral wall being formed unitarily with said outer peripheral part, said inner peripheral wall being formed unitarily with said inner peripheral part.

5. The swash-plate type piston pump motor as claimed in claim 1, wherein said outer peripheral wall flares radially outwardly with a taper angle of up to 30° relative to the direction of the output shaft.

* * * * *